US006721961B2

(12) United States Patent
Park

(10) Patent No.: US 6,721,961 B2
(45) **Date of Patent: *Apr. 20, 2004**

(54) CAP WITH A PLIABLE VISOR

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 8 days.

This patent is subject to a terminal disclaimer.

(21) Appl. No.: 10/090,623

(22) Filed: Mar. 6, 2002

(65) Prior Publication Data

US 2003/0074715 A1 Apr. 24, 2003

(30) Foreign Application Priority Data

Oct. 23, 2001 (KR) ..... 2001-0065345

(51) Int. Cl.[7] ..... A42B 1/00
(52) U.S. Cl. ..... 2/175.5; 2/175.2; 2/195.6
(58) Field of Search ..... 2/175.1–175.5, 2/195.1–195.6, 12, 195.7, 209.11, 209.12

(56) References Cited

U.S. PATENT DOCUMENTS 2,038,875 A * 4/1936 Siegelbaum ..... 2/175.2
3,357,026 A * 12/1967 Wiegandt ..... 2/195.6
D289,700 S 5/1987 Burns
4,777,667 A 10/1988 Patterson
4,839,924 A 6/1989 Laurence
5,450,629 A 9/1995 Gilstrap
5,669,071 A 9/1997 Vu
5,802,616 A * 9/1998 Watson ..... 2/175.1
5,845,339 A * 12/1998 Ashley et al. ..... 2/195.6
5,901,371 A 5/1999 Lee
5,908,146 A 6/1999 Levin
6,138,279 A * 10/2000 Gore ..... 2/175.5
6,237,156 B1 5/2001 Ellman
6,311,331 B1 * 11/2001 Park ..... 2/195.1
6,357,051 B1 * 3/2002 Lee ..... 2/195.1
6,408,443 B1 * 6/2002 Park ..... 2/195.1

* cited by examiner

*Primary Examiner*—Katherine Moran
(74) *Attorney, Agent, or Firm*—Jacobson Holman PLLC

(57) ABSTRACT

A baseball-style cap having a pliable visor which includes an upper fabric portion, a lower fabric portion, and a resilient stiffener placed therebetween. The cap further includes a piped fabric portion that is located between the upper and lower fabric portions, adjacent an outer periphery of such upper and lower portions, into which a deformable material is inserted. The combination of the resilient stiffener and the deformable material allows the visor to be readily bent or folded as well as easily restored to its original configuration. The resulting cap can be produced easily, is attractive in use and can be carried in a pocket without damage to the visor.

16 Claims, 8 Drawing Sheets

CAP WITH A PLIABLE VISOR

BACKGROUND OF THE INVENTION

1. Field of the Invention

The present invention is related to the field of caps having visors and, more particularly, to a baseball-style cap having a flexible yet shape-sustaining visor.

2. Description of the Related Art

As shown in FIG. 1, a baseball style cap 1 generally includes a crown main body 2, and a visor portion 3 that is secured to the forward edge of the crown and extends outwardly therefrom to provide protection from sunlight or rain. Such caps are widely used by persons of both sexes and all ages.

The process of manufacturing a conventional baseball-style cap, such as that shown in FIG. 1, is illustrated in FIGS. 2*a*–2*d* and 3. As shown in FIG. 2*a*, an upper fabric material 4 and a lower fabric material 5 are sewn along their outer circumferences to form the outer portion of the visor. The visor outer portion is turned inside-out and, as shown in FIG. 2*b*, a stiffening insert 7 made of hard material is inserted in the interior thereof between the upper fabric 4 and the lower fabric 5. The stiffening insert, which may be made of diverse materials such as cardboard and plastics, supports the outer portion so that the visor will not collapse.

As shown in FIG. 2*c*, the stiffening insert 7 is sewn with the upper and lower fabrics, including along a back line 9, so that the stiffening insert is held securely with the outer fabric materials. The resulting visor 3 is then connected with the crown main body 2, FIG. 2*d*, to a form a finished cap.

As illustrated in FIG. 3, in the process of manufacturing a conventional cap, the cross sectional structure taken along line A—A in the visor of FIG. 2*c* is composed of the upper fabric material 4, the stiffening insert 7, and the lower fabric material 5.

It is necessary to insert the stiffening insert into the visor in order to reinforce the visor so that it can act to protect the wearer from sunlight. With conventional caps, the stiffening insert is not resilient such that, once bent or folded, the visor cannot be restored to its original shape. Therefore, the cap cannot be folded and placed into the wearer's coat or trouser pocket when not in use, because to do so would permanently deform the visor. As a result, the wearer is required to carry the cap in hand if he or she does not have a suitable bag or other carrying case within which to place the cap when it is not being worn. This is inconvenient and also increases the likelihood that the wearer, in setting the cap down to do something else, will leave the cap unintentionally.

Alternatively, caps having inserts made of flexible fabric materials have been used. These are easy to carry but, because the exterior of the visor has very little supporting capability, the visor becomes slack following laundering, rendering the flexible insert ineffective.

Therefore, a need exists for a cap having a flexible visor, allowing the cap to be conveniently carried when not being worn, which is also sufficiently stiff to provide desired protection from the elements.

SUMMARY OF THE INVENTION

In view of the foregoing, one object of the present invention is to provide an improved cap structure that can support a visor and which is also convenient to carry when not being worn.

Another object of the present invention is a cap having a pliable visor which can be manipulated for effective use by individuals for a variety of outdoor purposes.

A further object of the invention is a cap having a visor that can be repeatedly deformed and returned to its original shape in accordance with various needs.

In accordance with these and other objects, the present invention is directed to a cap having a pliable visor which includes an upper covering portion, a lower covering portion, and a resilient stiffener placed therebetween. The cap further includes a piped covering portion that is located between the upper and lower covering portions, adjacent an outer periphery of such upper and lower portions, into which a deformable material is inserted.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
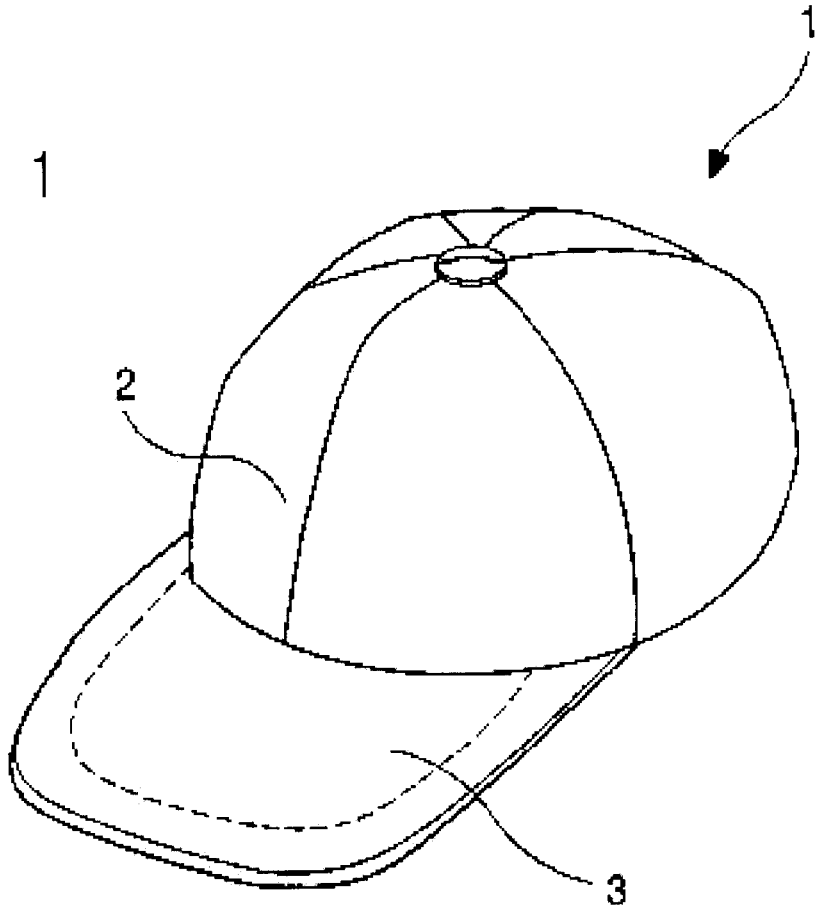
FIG. 1 is a perspective view of a conventional cap.
Figure 2A:
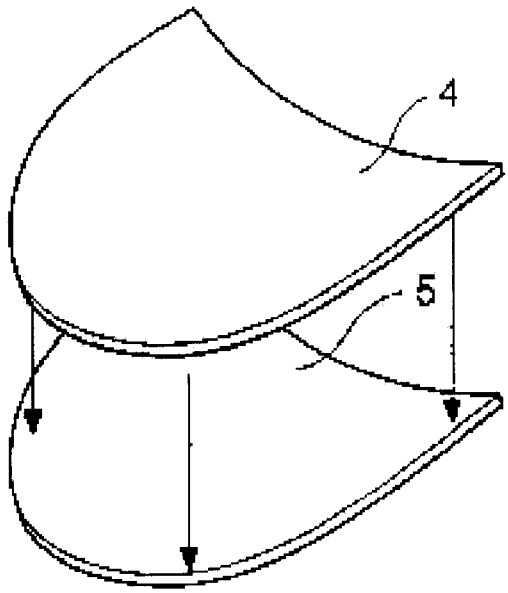
FIGS. 2*a*–2*d* are perspective views illustrating the manufacturing steps of the conventional cap of FIG. 1.
Figure 2B:
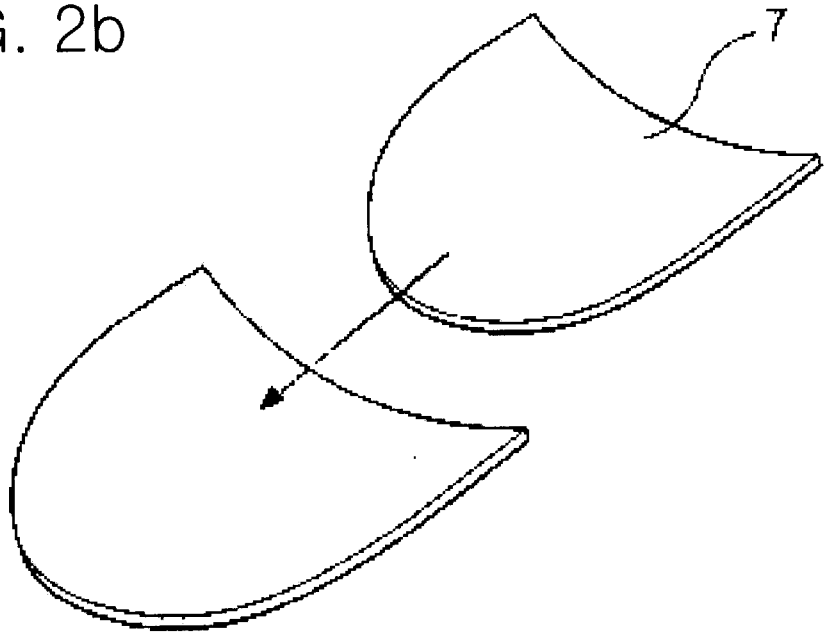
Figure 2C:
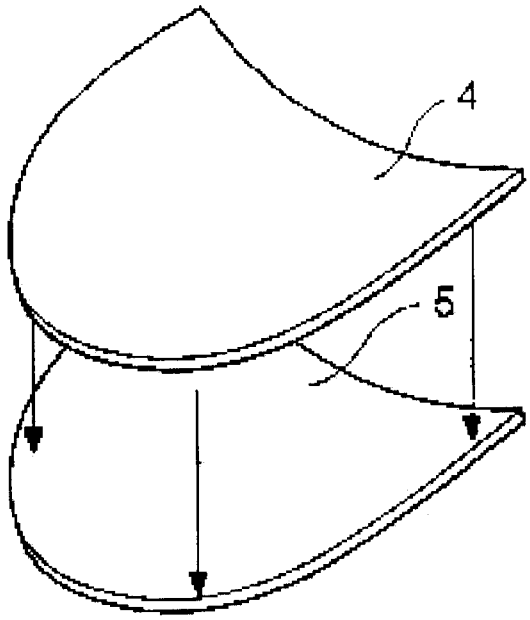
Figure 2D:
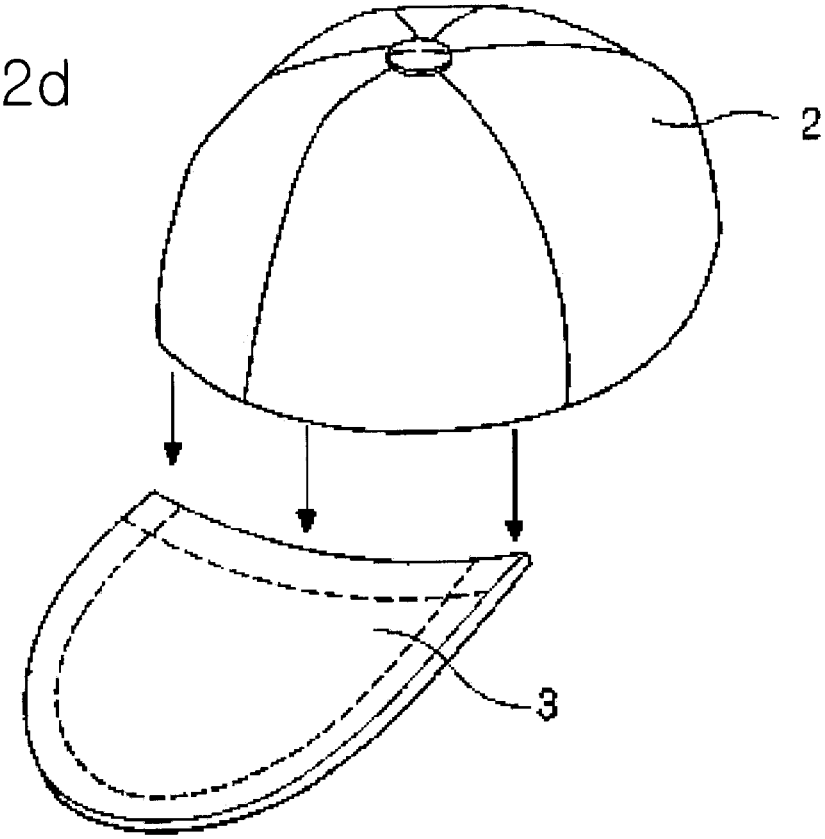
Figure 3:
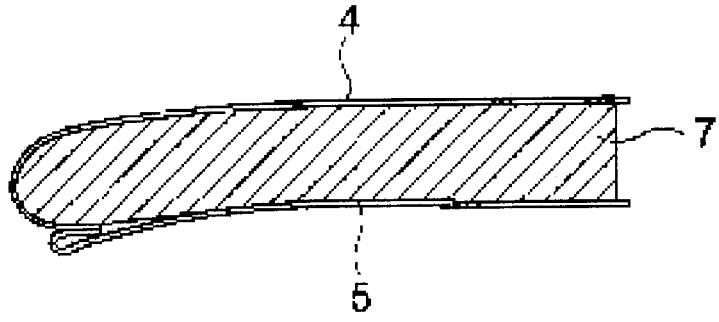
FIG. 3 is a cross-sectional view along line A—A of FIG. 2*c;*

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention, the present invention is directed to a baseball-style cap having a pliable, resilient visor. The structure of the visor includes a resilient stiffener and a deformable material. The resilient stiffener and deformable material are held in place by upper, lower and piped covering portions. The covering portions may be made of fabric, plastic, nylon, or any other similar material used to make clothing or clothing accessories. In the preferred embodiment, the covering portions are made of fabric and further discussion herein will refer to fabric portions; this is not meant to be limiting, however. Also in the preferred embodiment, the deformable material is embodied as a wire, but other supple and/or bendable materials may also be used.

Figure 4A:
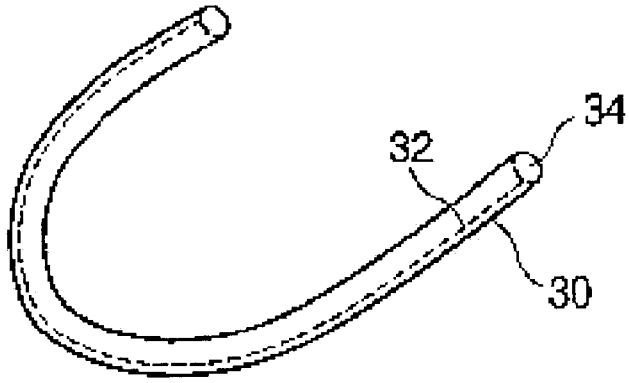
FIGS. 4*a*–4*f* are perspective views illustrating the manufacturing steps of a cap according to the present invention.
Figure 4B:
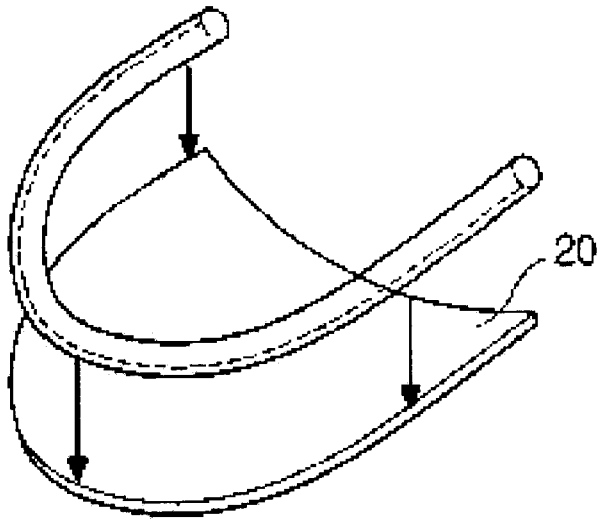
Figure 4C:
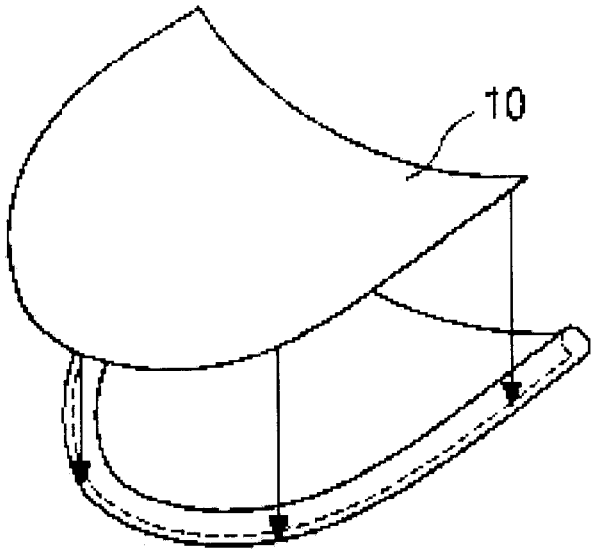

FIGS. 4*a*–4*f* illustrate the manufacturing steps undertaken to produce a cap according to the present invention. As shown in FIG. 4*a*, a piece of fabric is overlapped 32 to form a piped fabric portion 30 having a tubular channel 34 therein. Looking to FIG. 4*b*, the piped fabric portion 30 is placed on a lower fabric portion 20 which has been cut to the shape of the resilient stiffener 40. An upper fabric portion 10, also cut to the shape of the resilient stiffener, is then placed on top of the piped fabric portion 30, as shown in FIG. 4*c*. The upper and lower fabric portions have a visor end and a crown body end. The piped fabric portion is aligned with the outer circumference of the visor end.

The upper fabric portion 10, the piped fabric portion 30 and the lower fabric portion 20 are then sewn together along the visor end; the crown body end remains open. The resulting sewn fabric cover is turned inside out so that the stitching is on the inside. Alternative methods of fastening the upper, lower and piped fabric portions together could also be used, such as gluing, stapling, etc.

Figure 4D:
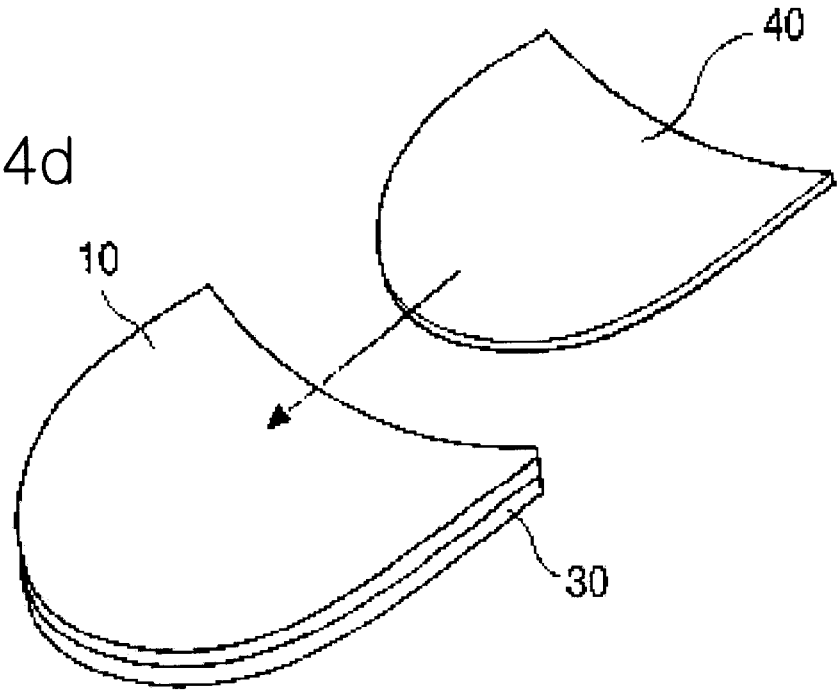

The resilient stiffener 40 is then inserted at the open crown body end between the upper and lower fabric portions so that the entry side of the resilient stiffener abuts the piped fabric portion 30, as shown in FIG. 4*d*. The resilient stiffener can be composed of hard materials such as cardboard, plastic, flexible plastic, etc. In a preferred embodiment, the resilient stiffener is made of an elastic fabric material which can strongly support the visor and also be transformed into various shapes into which it is held by the deformable material.

Figure 4E:
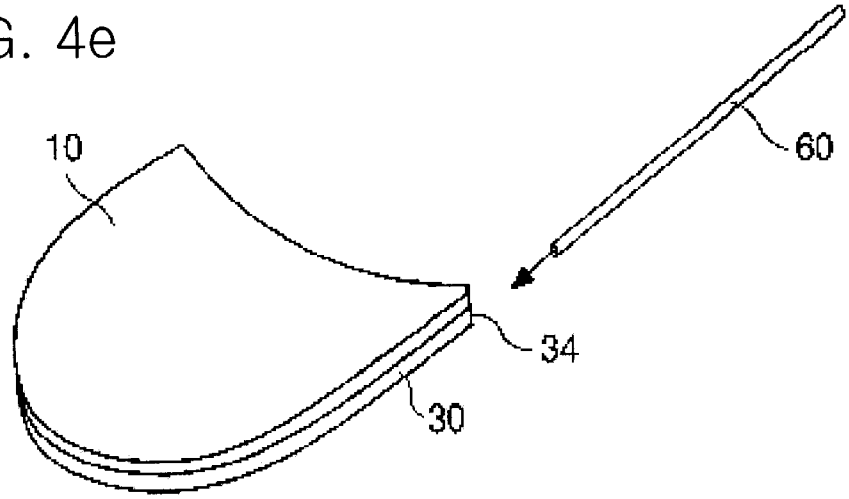

After insertion of the resilient stiffener, an elongated piece of deformable material 60 is inserted into the tubular channel 34 of the piped fabric portion 30, representatively shown in FIG. 4*e*. The deformable material 60 is preferably a wire, but may be composed of various plastic or metal materials. Any material which is deformable may be used. While the preferred embodiment is directed to a deformable material that substantially holds the shape into which it was last deformed, i.e., a material that does not immediately spring back to its original shape, it is possible to use resilient or elastic materials which have a stronger self-restorative force. Such elastic materials would not provide the full functionality as representatively shown in FIGS. 6*a* and 6*b*, but would enable the cap to be folded and carried in a pocket or other limited space while thereafter returning to an unbent, functioning visor configuration for wear. Hence, the present invention is intended to cover all such embodiments.

In the preferred embodiment shown, the elongated piece of deformable material inserted into the tubular channel is substantially the same length as the piped fabric portion. However, as a further alternative, the deformable material may be shorter than the piped fabric portion, being inserted into the most curved part of the visor, i.e., the outermost exterior edge of the visor end. In this alternative, the deformable material could very readily be any supple, pliable, resilient or elastic material, as has already been noted.

Figure 4F:
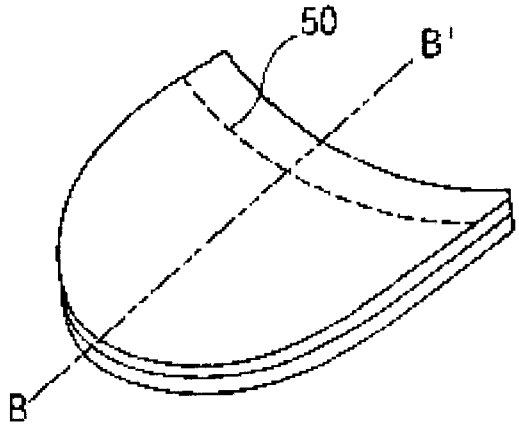
Figure 5:
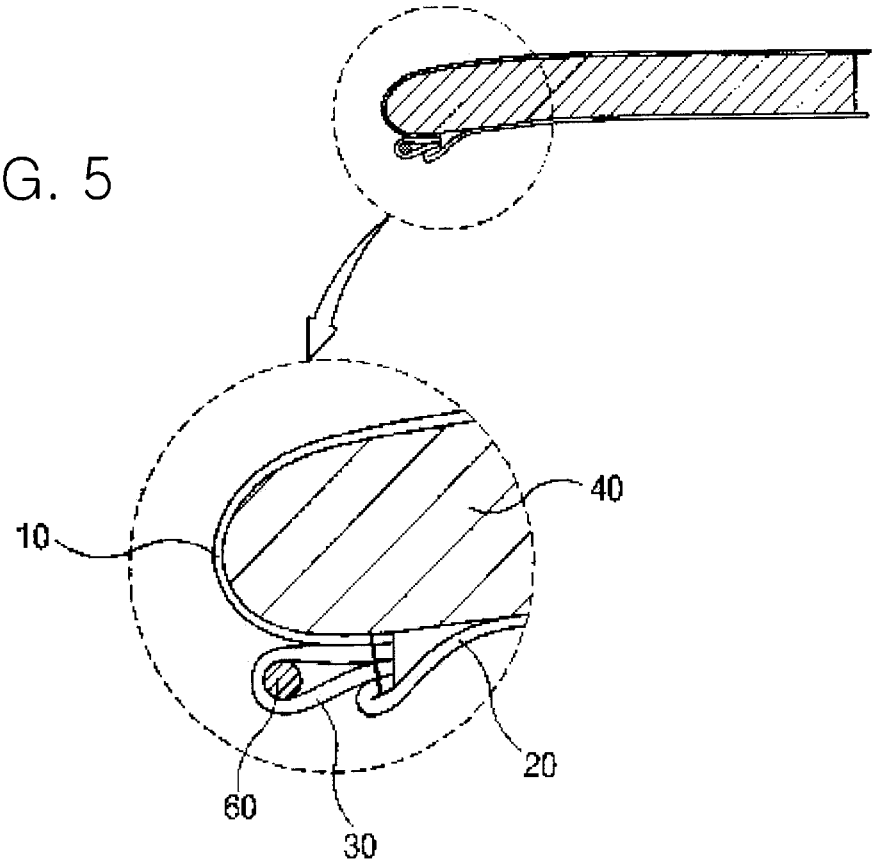
FIG. 5 is a cross-sectional view along line B—B of FIG. 4*f*.

Once the deformable material 60 has been inserted into the tubular channel 34, the resilient stiffener is preferably sewn to the upper and lower fabric portions along a back line 50 and is ready for attachment at the crown body end to the crown portion 2. A cross-sectional view taken along line B—B of FIG. 4*f* is shown in FIG. 5.

As an alternative method, the deformable material may be inserted into the tubular channel initially, prior to fastening of the upper, lower and piped fabric portions together.

In the preferred embodiment having the elongated piece of deformable material 60 at substantially the same length as the piped fabric portion 30, the deformable material 60 supports the outward form of the visor with the resilient stiffener 40. Because of the pliable nature of the deformable material 60, the resulting visor may be shaped and reshaped to a far greater extent than a visor having only a stiffening insert. The advantage of this flexibility is seen in FIGS. 6*a* and 6*b* which illustrate configurations of the cap when worn.

Figure 6A:
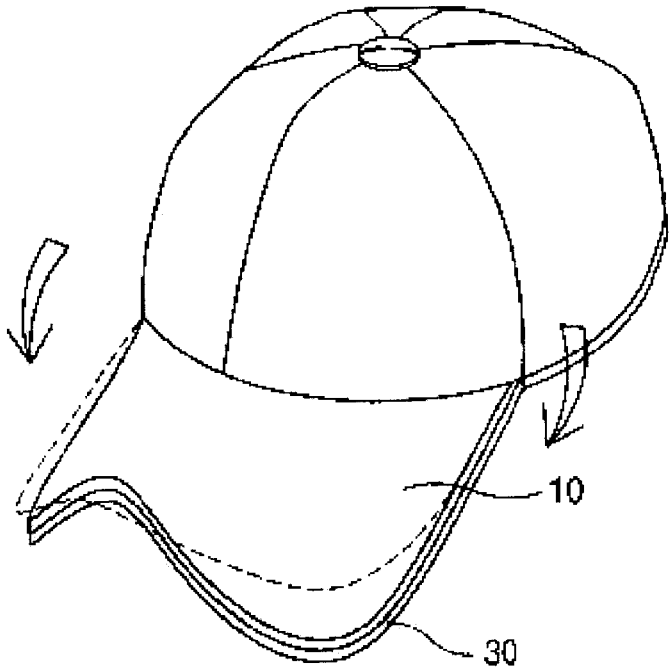
FIGS. 6*a* and 6*b* are perspective views of the cap according to the present invention, with the visor in various configurations as in use.
Figure 6B:
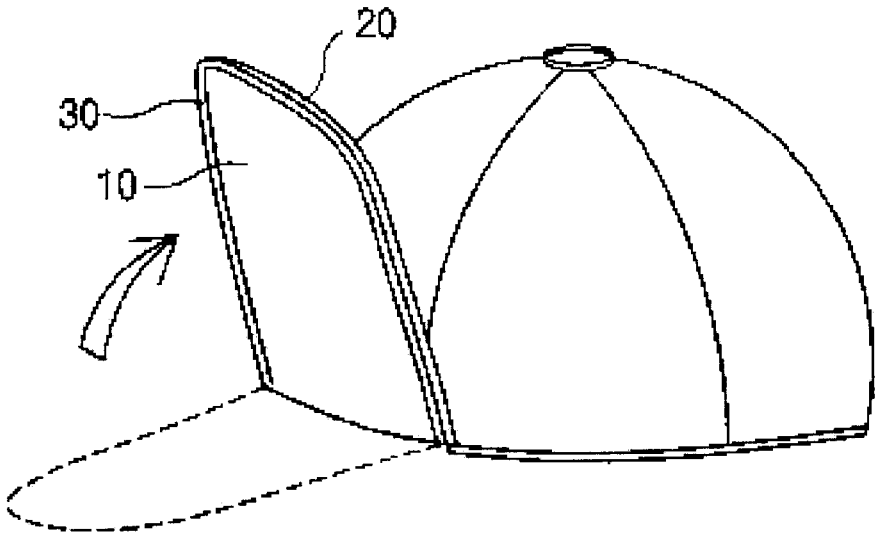

FIG. 6*a* shows a cap in which both sides of the visor have been cupped, with the centerline of the visor as the central axis. This cupped curvature is maintained by the resistance of the now reshaped deformable material 60. Unlike prior art visors, the visor according to the present invention may thereafter be restored to its original form, even after the visor has been extremely bent and assumes a U-shape, without any damage to the outward form of the visor.

When using caps for outdoor purposes such as golfing and driving, the visor can oftentimes obstruct vision, requiring the wearer to remove the cap or turn it around so that the visor faces backward. With the present invention, however, the visor can be folded in a vertical direction as shown in FIG. 6*b*. By folding the visor toward the front of the crown, there is no need to remove the cap or twist it about the head, which greatly increases convenience for the wearer.

The cap according to the present invention, which its combination of a resilient stiffener and a bendable, deformable material, is very durable, maintaining the form of the visor even after repeated laundering. The visor can withstand repeated reshaping, and is easily restored to a standard visor configuration after being folded and carried in one's pocket.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the piped covering portion with deformable material therein may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. A shapeable cap comprising:

a crown main body; and a pliable visor, said visor including, an upper fabric portion;

a lower fabric portion;

a piped fabric portion forming a tubular channel, said piped fabric portion being aligned with and between an outer circumference of said upper fabric portion and an outer circumference of said lower fabric portion;

a resilient stiffener inserted between said upper fabric portion and said lower fabric portion, a forward edge of said resilient stiffener abutting said piped fabric portion; and a deformable material inserted into said tubular channel.

2. The cap as set forth in claim 1, wherein said deformable material is a wire.

3. The cap as set forth in claim 1, wherein said resilient stiffener is an elastic fabric material.

4. The cap as set forth in claim 1, wherein said piped fabric portion is sewn to said upper and lower fabric portions.

5. The cap as set forth in claim 1, wherein said cap is a baseball-style cap.

6. A supple baseball-style cap comprising:

a crown main body; and a pliable visor, said visor including, an upper covering portion;

a lower covering portion;

a piped portion forming a tubular channel, said piped portion being aligned with and between an outer circumference of said upper portion and an outer circumference of said lower portion;

a resilient stiffener inserted between said upper portion and said lower portion; and a deformable material inserted into said tubular channel.

7. The baseball-style cap as set forth in claim 6, wherein said deformable material is a wire.

8. The baseball-style cap as set forth in claim 6, wherein said resilient stiffener is an elastic material.

9. The baseball-style cap as set forth in claim 6, wherein said piped portion is fastened to at least one of said upper and lower portions.

10. The baseball-style cap as set forth in claim 6, wherein said piped fabric portion is sewn to at least one of said upper and lower fabric portions.

11. The baseball-style cap as set forth in claim 6, wherein said upper covering portion is fabric.

12. The baseball-style cap as set forth in claim 6, wherein said lower covering portion is fabric.

13. A method of manufacturing a cap having a pliable visor, comprising the steps of:

wrapping a piece of fabric to form a piped fabric portion, said piped fabric portion defining a tubular channel;

placing said piped fabric portion along an outer circumference of a lower fabric portion, said lower fabric portion having a visor end and a crown body end, said piped fabric portion aligned along said outer circumference on said visor end;

placing an upper fabric portion on top of said piped fabric portion so that an outer circumference of said upper fabric portion overlies said piped fabric portion;

fastening said upper fabric portion, said piped fabric portion and said lower fabric portion together along said visor end to form a fabric cover;

reversing said fabric cover to be inside-out;

inserting, at said crown body end, a resilient stiffening member between said upper and lower fabric portions;

inserting, at said crown body end, an elongated piece of deformable material into said tubular channel; and fastening said crown body end to a crown body member.

14. The method as set forth in claim 13, wherein the step of fastening said upper fabric portion, said piped fabric portion and said lower fabric portion together is done by sewing.

15. The method as set forth in claim 13, further comprising, after the step of inserting the elongated piece of deformable material, the step of sewing said upper and lower fabric portions and said resilient stiffener along a back line adjacent said crown body end.

16. The method as set forth in claim 13, wherein each of said steps of fastening are done by sewing.

* * * * *